United States Patent [19]

Day

[11] 4,124,120

[45] Nov. 7, 1978

[54] THIN-WALLED CUPS CAPABLE OF NESTING

[75] Inventor: Robert H. Day, Bracknell, England

[73] Assignee: ITW Limited, Slough, England

[21] Appl. No.: 791,920

[22] Filed: Apr. 28, 1977

[30] Foreign Application Priority Data

Apr. 28, 1976 [GB] United Kingdom ..... 17152/76

[51] Int. Cl.[2] ..... B65D 21/02; B65D 85/72

[52] U.S. Cl. ..... 206/519; 206/217; 206/520

[58] Field of Search ..... 206/217, 519, 520; 229/1.5 B

[56] References Cited

U.S. PATENT DOCUMENTS

| | | | |
|---|---|---|---|
| 1,889,111 | 11/1932 | Serr | 206/217 |
| 3,512,677 | 5/1970 | Kovac | 206/520 |
| 3,927,766 | 12/1975 | Day | 206/519 |

*Primary Examiner*—George E. Lowrance

*Attorney, Agent, or Firm*—Edward L. Benno; Robert W. Beart

[57] ABSTRACT

A thin-walled cup including wall portions having internal and external surfaces so shaped that, when the cup is nested with an identical cup in an upright attitude, the said external surfaces of the upper cup cooperate with the said internal surfaces of the lower cup, so as to resist separation of the cups, provide a seal between the cups, and provide for cushioned relative movement of the cups towards each other, with a limit to such movement.

1 Claim, 5 Drawing Figures

Fig. 2.
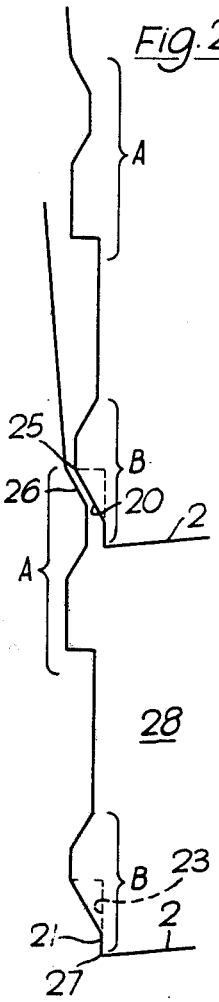
Fig. 3.
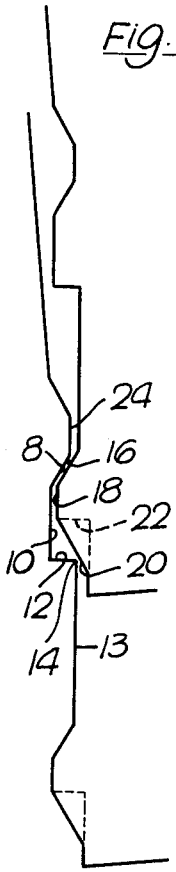
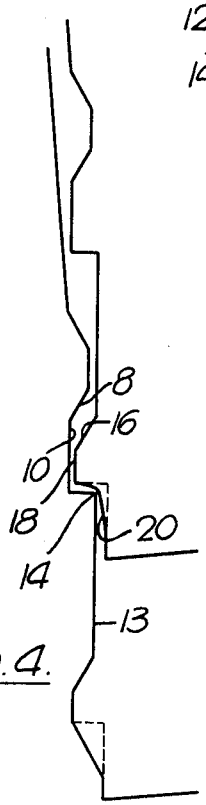
Fig. 4.
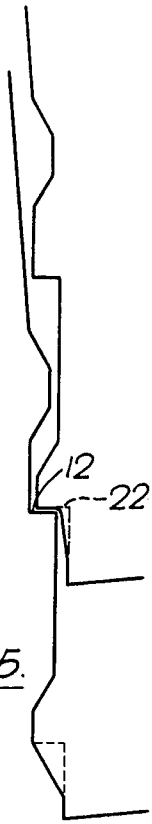
Fig. 5.

THIN-WALLED CUPS CAPABLE OF NESTING

In one known procedure for vending drinks from a machine, a considerable number of thin-walled cups are supplied to the machine nested together into a stack, with an appropriate quantity of soluble drink ingredient located in each of the spaces which exist between the bottom of one cup and the bottom of the next cup above. In use, cups are removed one by one from the bottom of the stack, and each cup is filled with water, usually nearly boiling, which thereupon dissolves the ingredient. Thus a drink is produced in each cup, ready for consumption.

Such cups can also be used in a dispenser from which cups can be removed one at a time by hand.

The present invention relates to thin-walled cups which are suitale for these uses. It is necessary for such cups to satisfy a number of requirements relating to mechanical performance. These requirements not only relate to performance when a stack is ready for cups to be removed one by one, but relate also to performance during transit from a factory in which cups are assembled into stacks, and during storage.

Thus the invention relates in particular to thin-walled cups, known from many prior patents, including wall portions having internal and external surfaces so shaped that, when the cup is nested with an identical cup in an upright attitude, the said external surfaces of the upper cup cooperate with the said internal surfaces of the lower cup.

According to the present invention, the said external and internal surfaces cooperate in the following manner:

(a) in a first nested condition, two of the said surfaces which are cylindrical form a circumferentially continuous sliding seal;

(b) the said wall portions of the two cups permit relative vertical movement of the cups towards each other from the first nested condition through a predetermined travel to a second nested condition, while exerting resistance to such movement;

(c) throughout the travel between the first and second nested conditions, the said two cylindrical surfaces maintain the sliding seal;

(d) when the cups are in the second nested condition, certain of the said surfaces about and thereby stop further vertical movement of the cups toward each other; and (e) in the first nested condition, certain of the surfaces interengage by tangency to an imaginary surface which is oblique to the vertical, so as to resist separation of the cups by requiring that separation of the cups from the first nested condition is accompanied by temporary horizontal deflection of at least one of the said wall portions.

These various basic features of cups in accordance with the present invention will be best understood from consideration of one particular example, given by way of illustration. This is shown in the accompanying drawings in which:

FIG. 2 to 5 are fragmentary enlarged diagrams showing the manner of interengagement of two adjacent cups in a stack, under various conditions. (For clarity, surfaces which in fact touch each other are shown slightly separated).

Figure 1:
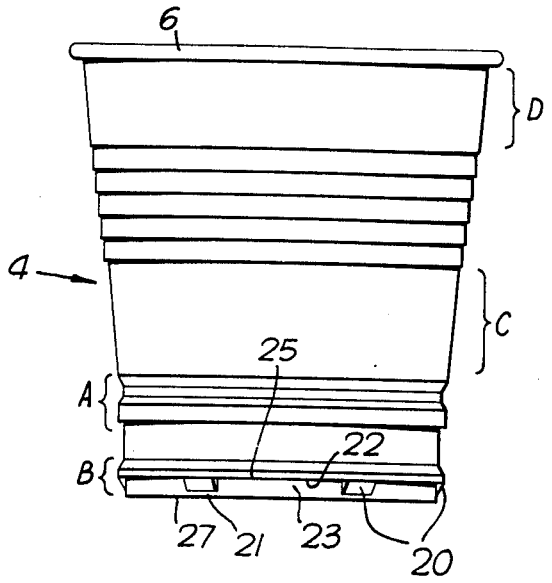
FIG. 1 is a side elevation of one cup.

The cup shown by way of example has a flush-filled capacity of 220 cc., and is made of high impact polystyrene, with an average wall thickness of 0.2 mm.

The cup shown in the drawings has a bottom wall 2 and a side wall 4, the side wall having a shape which, basically, is divergent upwards and outwards from the bottom wall to a rim 6.

When a number of identical cups as shown in FIG. 1 are assembled together in a stack in an upright attitude, the interengagement of the cups takes place by cooperation between a wall portion A of one cup and a wall portion B of another cup. That is to say the internal surfaces of the portion A cooperate with the external surfaces of the portion B of the next cup above in the stack, while external surfaces of the portion B cooperate with internal surfaces of the portion A of the next cup beneath in the stack.

The normal nested condition of two adjacent cups in the stack is as shown in FIG. 3. In the broad definition above, this is referred to as the "first nested condition". The bottom walls 2 of adjacent cups are then spaced apart by a vertical distance of 12.5 mm. This distance is known as the "stacking height".

The wall portion A has internal surfaces 8, 10, and 12, and a shoulder 14 at the junction of the surface 12 and a surface 13. The wall portion B has external surfaces 16 and 18, and a circumferential alternate series of external surfaces 20 and 22.

The surfaces 10 and 18 are cylindrical and circumferentially continuous. They form a circumferentially continuous sliding seal in the normal nested condition. As explained later in this specification, the seal may involve exact fit, or slight interference, or slight clearance.

The surface 8 and 16 are frusto-conical, divergent downwards at the same angle, and are circumferentially continuous. They form a second circumferentially continuous seal in the normal nested condition, and also act as abutments resisting separation of the cups. Preferably the surfaces 8 and 16 are at 30° to the central vertical axis of the cup.

The surfaces 20 are arcs of an interrupted frusto-conical surface, convergent downwards. The surfaces 22 are arcs of an interrupted flat annular horizontal surface. Preferably, as shown, there are six surfaces 20, each of 15° circumferential extent, and six surfaces 22, each of 45° circumferential extent. All the surfaces 20 and 22 meet the lower boundary 25 of the cylindrical surface 18. The surfaces 20 and 22 are linked to the periphery 27 of the bottom wall 2 by vertical surfaces 21 and 23, respectively. These surfaces 21 and 23 are all arcs of a common vertical cylindrical surface.

The surface 12 is a flat horizontal annulus. Preferably the surface 13, which extends downwards from the shoulder 14, is vertical and cylindrical and extends downwards to join the portion B of the same cup. The surfaces 20 engage the shoulder 14 in the normal nested condition, and provide resistance against relative axial movement of the cups towards each other. Preferably the surfaces 20 are at 30° to the central vertical axis of the cup. The surfaces 12 and 22 constitute abutments which limit relative axial movement of the cups towards each other, as described more fully below.

The cups can be separated from one another by exerting forces axially upwards and downwards on the upper and lower of two adjacent cups, for example by applying forces to the rims 6 of the respective cups. Sufficient axial forces will cause the frust-conical surfaces 8 and 16 to slide past one another, the wall portion A being temporarily deformed somewhat radially outwards, while the wall portion B is temporarily deformed somewhat radially inwards, until the surface 18 is able to pass an internal surface 24. Continued application of axial forces will cause the surfaces 18 and 24 to slide past one another, until the cups become entirely separated from each other.

During assembly into a stack, the cups are first brough to the relative position shown in FIG. 2, in which the surfaces 20 rest on an internal surface 26, which is frusto-conical, divergent upwards and outwards, and is circumferentially continuous. The relative position shown in FIG. 2 can be used as a condition of temporary stacking of cups, between the stage of manufacture of the cups, and a stage in which the cups are separated, charged with drink concentrate, and then assembled into the normal nested condition shown in FIG. 3. In this latter assembly operation, after the concentration has been placed in the space 28 between the bottoms 2 of the adjacent cups, axial forces are applied to the cups to urge them towards one another, and the consequence is that the surfaces 20 ride over the surface 26, with temporary outward deflection of the wall portion A and temporary inward deflection of the wall portion B, until the surfaces 18 and 24 can slide past one another, and the cups reach the position shown in FIG. 3. As the cups approach the FIG. 3 position, the wall portions A and B return towards their unstressed shapes, so that the surface 18 is of greater radius than the surface 24, and the surfaces 10, 18, and 8, 16 cooperate to form two seals, as described above, while the surfaces 20 engage the shoulder 14. Preferably the surface 26 is at 30° to the central vertical axis of the cup.

It is quite probable that, at some stage during transit between a factory where a stack of cups is assembled, and a place of use, the stack will be dropped, in such a manner as to experience considerable axial shock. For example, a case containing a number of stacks may be dropped from a platform of a truck to the ground. The function of the parts of the wall portion B which present the surfaces 20 is to cushion such shock, in the manner shown in FIG. 4, thereby protecting the cups against damage. During this cushioning action, the parts presenting the surfaces 20 of the upper of two adjacent cups become deformed, while the shoulder 14 of the lower cup remains substantially unchanged in shape. The cups move relatively axially towards each other, so that the seal between the surfaces 8 and 16 is temporarily broken; but the seal between the cylindrical surfaces 10 and 18 is not broken by this relative axial movement. The maximum relative travel of the cups is as far as the position shown in FIG. 5, this being what is referred to as the "second nested condition" in the general definition above.

When the cups reach the position shown in FIG. 5, the surfaces 22 engage the surface 12, and abut it over a substantial area, and thus firmly stop any further axial relative movement of the cups towards each other. By this means, one ensures that the remainder of the side walls of the two adjacent cups (especially wall portions C and D (FIG. 1) cannot approach each other so closely as to produce a risk of wedging together. Such wedging, if it were to occur, would of course prevent satisfactory separation of the cups from one another at a place of use.

The proportions of the wall portions A and B are selected, having regard to the wall thickness used in the cups, to ensure that the deformation of the surfaces 20 between the condition shown in FIG. 3 and the condition shown in FIG. 5 is not such as to produce any permanent damage to the cup. Preferably, the proportions are so chosen that the resilience of the wall portion B is unimpaired after such temporary deformation, so that, at the conclusion of the axial shock, the two adjacent cups return automatically to the relative position shown in FIG. 3, in which the seal between the surfaces 8 and 16 is re-established.

The cups can conveniently be made by thermo-forming from flat sheet stock, using a mandrel to stretch the sheet partially, and air pressure differential to carry the sheet into contact with a female mould which determines the external shape of the finished cup. This external shape is not identical to that of the mould, because of shrinkage during cooling; and the internal shape of the cup is determined indirectly from the external shape, in accordance with the local thickness of the material in the finished cup. With this method of manufacture, the dimensions of the cooperating inner and outer surfaces described above are subject to some uncertainty. In particular, what has been referred to above as a "seal" between the cylindrical surfaces 10 and 18 may involve a slight interference, or may involve a slight clearance. Because of this possibility, the wall portions A and B are preferably proportioned so that, in the first nested condition shown in FIG. 3, the surfaces 20 are slightly deformed by engagement with the shoulder 14. In this way one ensures that, in returning from the position of FIG. 5 to the position of FIG. 3, any friction between the surfaces 10 and 18 will be adequately overcome throughout the return travel.

On the other hand, although there is a possibility of slight clearance between the surfaces 10 and 18, such as might admit atmospheric air to the drink ingredient, or even permit fine powder to escape between the surfaces 10 and 18, the frusto-conical surfaces 8 and 16 provide a second seal which is not critically dependent upon dimensions of the cooperating surfaces 8 and 16, but simply depends on the surfaces 8 and 16 being pressed together axially in the first nested condition shown in FIG. 3. This axial pressing is produced by the slight deformation of the surfaces 20 by the shoulder 14 which is preferably provided for in this condition, as mentioned in the previous paragraph.

The surfaces 8 and 16 do of course separate from each other under axial shock condition, as shown in FIGS. 3 to 5, but the surfaces 10 and 18, even if there is slight clearance between them, provide considerable obstruction to escape of ingredient, and in particular ensure that, during the brief period of axial shock, particles of ingredient do not reach the gap which then exists between the surfaces 8 and 16. Consequently, when the cups return to the condition shown in FIG. 3, a good seal is re-formed between the surfaces 8 amd 16, and there is no likelihood of these surfaces being held apart by particles of ingredient.

Comparing the example shown in the drawings with the basic features stated in the fourth paragraph of this specification, it will be seen that, in the example, a first wall portion A of a side wall has a succession of circumferential internal surfaces, one below another, namely a first frusto-conical surface, divergent downwards (being one of the surfaces mentioned at (e)), a first cylindrical surface (being one of the surfaces mentioned at (a)), a first horizontal surface (being one of the surfaces mentioned at (d)), and a shoulder at the junction of the inner boundary of the first horizontal surface and a further surface extending downwards; and a second wall portion B of the side wall, below the first wall portion, has a succession of circumferential external surfaces, one below another, namely a second frusto-conical surface (being the other of the surfaces mentioned at (e)) divergent downwards at the same angle as the first frusto-conical surface, a second cylindrical surface (being the other of the surfaces mentioned at (a)), a series of second horizontal surfaces (being the others of the surfaces mentioned at (d)), and a series of third frusto-conical surfaces convergent downwards; the second horizontal surfaces and the third frusto-conical surfaces being alternate around the circumference of the cup, and all meeting the lower boundary of the second cylindrical surface.

Although it is desirable to have a first "seal" provided by the surfaces 10 and 18, and a second seal provided by the surfaces 8 and 16, this is not absolutely essential, particularly if the cups are being used in circumstances such that the period of storage between assembly and use of a stack of cups will be short, or if the drink ingredient is not sensitive to damage by atmospheric air. For such uses, the continuous surface 8 might be replaced by a surface which is circumferentially intermittent.

Although the surfaces 8 and 16 are shown as frusto-conical, other shapes are possible, for example each surface, in vertical cross section, might be partly curved concave towards the interior of the cup, and partly curved convex to the interior of the cup, after the manner of a shallow letter S.

In the example shown in the drawings, both of the wall portions A and B are entirely in the side wall of the cup. However, it is possible that the wall portion B may extend down to the bottom wall, or even include part of the bottom wall.

In the example shown in the drawings, the cushioning against axial shock is provided by the surfaces 20 which are oblique to the central vertical axis of the cup. Other forms of cushioning may be used. For example, cushioning of stacks of nested cups is described in British Pat. No. 865 024, and the surfaces 20 in the present application resemble surfaces 140 in FIGS. 9 to 13 of that patent; other forms of cushioning shown in that Patent, namely in FIGS. 14 to 21 of the Patent, may be used in the present invention.

In the example shown, the bottom wall and side wall of the cup are each of a single thickness of material. The present invention is also applicable to double-walled cups, consisting of an inner and an outer component fitted one within the other, and usually secured together at the rim. In such a double-walled cup, the wall portion A is required to be on the inner component, while the wall portion B is on the outer component.

In the example shown, the surfaces 8, 16 which resist separation of adjacent cups are above the surfaces 10, 18 which provide a cylindrical seal, and all these are above the surfaces 14, 20 which provide cushioning and the surfaces 12, 22 which stop movement of the cups towards each other. However, the relative vertical positions of these different pairs of surfaces may be re-arranged.

If desired, a labyrinth effect may be produced by modifying the wall part presenting the surface 13, so as to provide for a third seal between the surface 24 (FIG. 3) of the lower cup and the exterior of the upper cup immediately within the surface 24 of the lower cup.

I claim:

1. In a container formed from a uniform thickness thermoplastic sheet material, said container having a bottom wall and a sidewall diverging upwardly from the bottom wall to a rim at the open upper end thereof, said container further having a stacking and locking means formed in the sidewall of said container for releaseably interlocking a plurality of said containers in a nested relationship with an ingredient chamber between the bottom walls of adjacent containers, the improvement of said stacking and locking means comprising a lower stacking shoulder and an upper stacking shoulder a substantial distance above said lower stacking shoulder, said shoulders comprising annular surfaces lying in planes perpendicular to the longitudinal axis of said container and in substantial vertical alignment, a plurality of camming surfaces disposed in a spaced apart relationship circumferentially about said container and extending downwardly and inwardly from the radially outward edge of said lower stacking shoulder to resiliently urge said lower stacking shoulder from contact with the upper stacking shoulder of a nested container therebelow, a lower cylindrical wall portion extending upwardly from the radially outward edge of said lower stacking shoulder, an upper cylindrical wall portion extending upwardly from the radially outward edge of said upper stacking shoulder, the outer diameter of said lower cylindrical wall portion substantially equal to the inner diameter of said upper cylindrical wall portion to effect a seal therebetween, a frusto-conical lower wall portion extending upwardly and inwardly from the upper end of said lower cylindrical wall portion, a frusto-conical upper wall portion extending upwardly and inwardly from said upper cylindrical wall portion at substantially the same angle of inclination as said frusto-conical lower wall portion, and said upper cylindrical wall portion having a height relative to the height of said lower cylindrical wall portion to provide a seal between the inner surface of said frusto-conical upper wall portion of one of said containers and the outer surface of said frusto-conical lower wall portion of another nested sub-adjacent container with the camming surfaces of the superposed container resiliently urging the lower stacking shoulder thereof from contact with the upper stacking shoulder of the sub-adjacent container.

* * * * *